US005421492A

United States Patent [19]

Barger et al.

[11] Patent Number: 5,421,492

[45] Date of Patent: Jun. 6, 1995

[54] METERED AEROSOL DISPENSING APPARATUS AND METHOD OF USE THEREOF

[75] Inventors: Lee A. Barger, Cary; Terence G. H. Bowyer, Raleigh; Ignatius L. Britto; Michael L. Franklin, both of Cary, all of N.C.

[73] Assignee: Glaxo Inc., Research Triangle Park, N.C.

[21] Appl. No.: 146,563

[22] Filed: Nov. 2, 1993

[51] Int. Cl.[6] ..... B65D 83/00

[52] U.S. Cl. ..... 222/402.2; 222/1; 222/459

[58] Field of Search ..... 222/402.16, 402.2, 459, 222/1

[56] References Cited

U.S. PATENT DOCUMENTS

| | | | |
|---|---|---|---|
| 2,886,217 | 5/1959 | Thiel . | |
| 3,052,382 | 9/1962 | Gawthrop | 222/402.2 X |
| 3,394,851 | 7/1968 | Gorman | 222/402.2 |
| 3,586,216 | 6/1971 | Jordan et al. . | |
| 3,900,139 | 8/1975 | Myers . | |
| 4,133,461 | 1/1979 | Vercelot . | |
| 4,506,803 | 3/1985 | Franklin et al. . | |
| 4,597,512 | 7/1986 | Wilmot . | |
| 4,744,495 | 5/1988 | Warby . | |
| 4,819,834 | 4/1989 | Thiel . | |
| 4,875,605 | 10/1989 | Weston . | |
| 4,886,193 | 12/1989 | Wassilieff . | |
| 4,887,743 | 12/1989 | Blake . | |
| 4,944,433 | 7/1990 | Knecht et al. | 222/402.2 |
| 5,007,556 | 4/1991 | Lover . | |
| 5,037,012 | 8/1991 | Langford | 222/402.2 |

FOREIGN PATENT DOCUMENTS

| | | |
|---|---|---|
| 0567348A1 | 10/1993 | European Pat. Off. . |
| 0616953A1 | 9/1994 | European Pat. Off. . |
| 2004526 | 4/1979 | United Kingdom . |
| 2086845 | 5/1982 | United Kingdom . |
| 2124587 | 2/1984 | United Kingdom . |
| 2195986 | 4/1988 | United Kingdom . |
| 2198117 | 6/1988 | United Kingdom . |
| 2251898 | 7/1992 | United Kingdom . |
| WO88/07010 | 9/1988 | WIPO . |
| WO92/11190 | 7/1992 | WIPO . |
| WO93/14005 | 7/1993 | WIPO . |
| WO93/22221 | 11/1993 | WIPO . |
| WO94/01347 | 1/1994 | WIPO . |

*Primary Examiner*—Gregory L. Huson
*Attorney, Agent, or Firm*—Charles E. Dadswell

[57] ABSTRACT

The present invention relates to an aerosol dispensing apparatus, more particularly to aerosol dispensing valves incorporating a controlled metered dispensing function wherein the metering chamber holding the next aerosolized dose is in fluidic communication with the reservoir allowing homogenous mixing of the next aerosolized dose to be dispensed.

21 Claims, 10 Drawing Sheets

METERED AEROSOL DISPENSING APPARATUS AND METHOD OF USE THEREOF

BACKGROUND OF THE INVENTION

Metered aerosol dispensing valves have been used in many devices and are well known in the art. Metered aerosol dispensing valves have been disclosed by a number of references. Examples include: U.S. Pat. No. 4,506,803, issued Mar. 26, 1985 to Franklin et al.; U.S. Pat. No. 4,142,652, issued Mar. 6, 1979 to Platt and U.S. Pat. No. 3,974,941, issued Aug. 17, 1976 to Mettler.

One particularly important use of metered aerosol dispensing valves is in the dispensing of aerosolized active agents, one example being a medicament. When dispensing aerosolized medicaments the quantity of the dispensed dose is of critical significance. Many medicaments have narrow therapeutic windows requiring the quantity of each dispensed dose to fall within specific circumscribed limits.

Another problem encountered with the metered dispensing of aerosolized medicaments is the medium within which the medicament is contained. Most aerosolized medicaments are in a fluid-like medium; a solution, suspension or emulsion. This liquid formulation also contains various excipients such as lubricants, diluents and propellants. One preferred aerosol drug formulation is described in U.S. Pat. No. 5,126,123, issued Jun. 30, 1992 to Johnson, and incorporated herein by reference.

Medicaments contained in an emulsion or suspension require frequent mixing to keep the combination of medicament and the various other required components of the formulation in a homogenous state, preventing the settling of a suspension or the separation of an emulsion. However, many prior art metered aerosol dispensing valves sequester a single dose within a metering chamber or bottle emptying device, secluding this single, next-to-be-used dose, from the reservoir containing the medicament supply. This sequestering prevents any applied mixing energy from homogeneously blending the medicament within the metering chamber with the remaining medicament supply contained within the reservoir. An example of this prior design can be found in U.S. Pat. No. 4,142.652, issued Mar. 6, 1979 to Platt. These prior art valve designs, when utilized with medicaments in a suspended or emulsified form, results, many times, in aerosolized doses or "shots" that expel either greater or lesser quantities of medicament compared to the specific dose required.

It is therefore an object of the present invention to define and delineate a metered aerosol dispensing apparatus, more particularly an aerosol dispensing valve, incorporating a controlled metered dispensing function having a flow-through metering chamber allowing the active agent contained within the metering chamber and the reservoir to mix when agitated. It is also an object of this invention to provide a homogenous mixture of the active agent within the metering chamber and reservoir; yielding aerosolized doses that have a consistent and constant dosing profile. These objects and further objects will become evident from the description of the invention below.

SUMMARY OF THE INVENTION

The invention comprises an aerosol dispensing apparatus, and method of use thereof, for dispensing metered amounts of fluid material. The aerosol dispensing apparatus comprises:

a) a metering chamber having at least one metering chamber port connecting the metering chamber to the reservoir; and b) a stem comprising a sealing segment and a dispensing passage; wherein the stem occupies;

i) a first position, wherein the stem is located such that the metering chamber is fluidically isolated from the dispensing passage; and the metering chamber is in fluidic communication with the reservoir through the metering chamber port; and ii) a second position, wherein the stem is located such that the metering chamber is in fluidic communication with the dispensing passage; and the metering chamber is fluidically isolated from the reservoir.

METHOD OF USING THE APPARATUS

The method of using the apparatus is simple and straight forward. The metered aerosol dispensing apparatus is, in many cases, used with an additional dispensing apparatus, which disperses the aerosolized dose of fluid. An example of a dispensing apparatus is described in U.S. Pat. No. 4,834,083, issued May 30, 1989 to Byram et al.

A user shakes the reservoir containing the metering valve, thoroughly mixing the fluid components contained within the reservoir and metering chamber. When the user agitates the reservoir, the metering valve is in the decompressed or closed position; the sealing segment of the stem is positioned to allow fluid within the reservoir and the metering chamber to mix and fully communicate via the metering chamber ports. After thoroughly mixing the fluid contained in the reservoir and the metering chamber by mechanical agitation such as shaking, the stem is actuated resulting in fluidic communication between the dispensing passage and the metering chamber. The dose residing within the metering chamber is then dispensed via the dispensing passage. When the metering valve is actuated and the dispensing passage is in communication with the metering chamber, the sealing segment is in a position such that the metering chamber ports are sealed preventing any additional fluid from moving into the metering chamber from the reservoir. Sealing the metering chamber ports allows dispensing of only the amount of fluid contained within the metering chamber. Once the dose, contained within the metering chamber is dispensed, the stem is returned to the closed or rest position resulting in the sealing segment once again allowing the metering chamber ports to come into fluidic communication with the reservoir; refilling the metering chamber.

BRIEF DESCRIPTION OF THE DRAWINGS

While the Specification concludes with claims particularly pointing out and distinctly claiming the invention, it is believed the invention will be better understood from the following description taken in conjunction with the associated drawings, in which like elements are described by the same reference numeral and related elements are designated by adding one or more prime symbols.

DETAILED DESCRIPTION OF THE INVENTION

Figure 1:
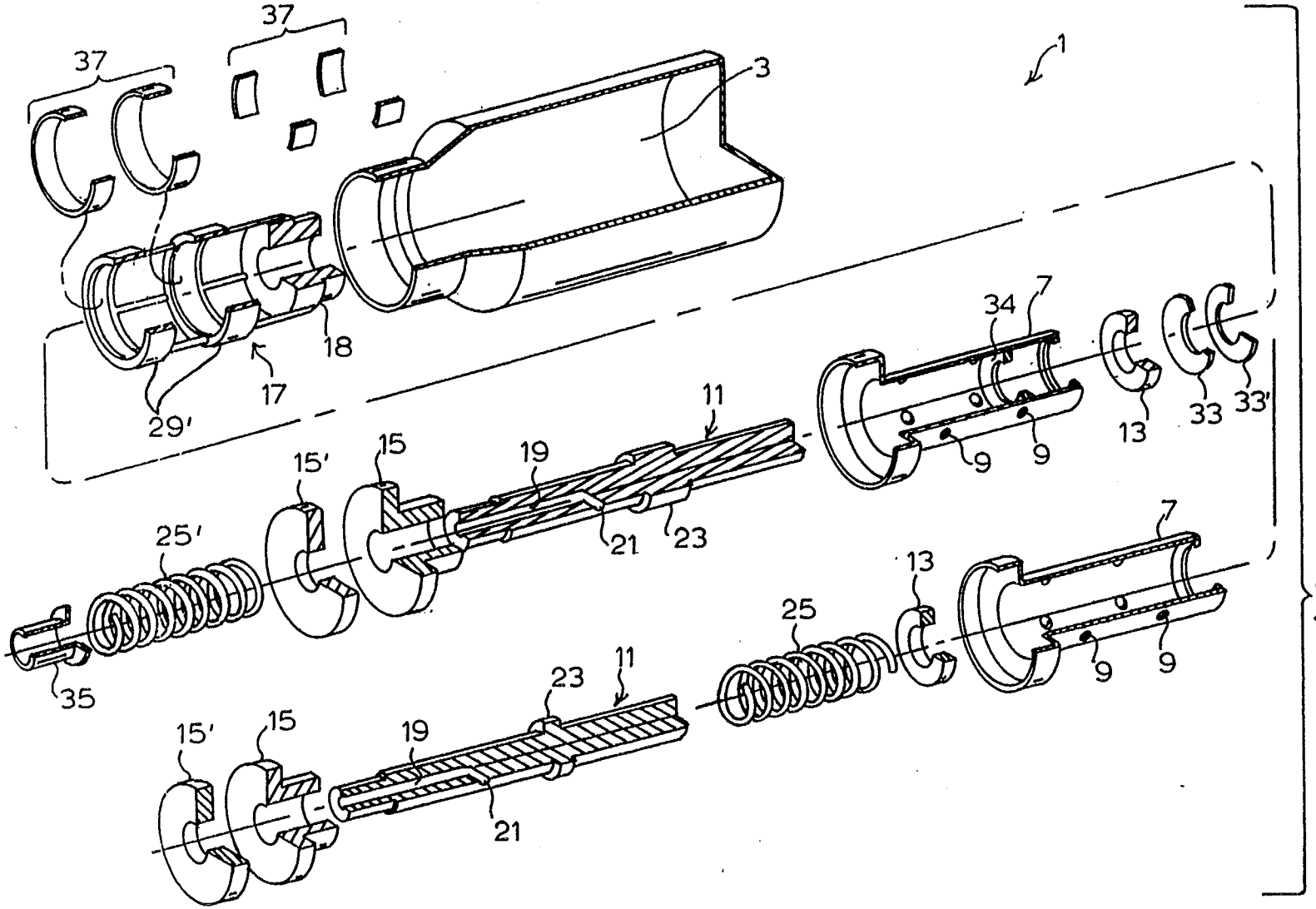
FIG. 1 is an exploded perspective cut-away view of one embodiment of the aerosol dispensing apparatus.
Figure 2A:
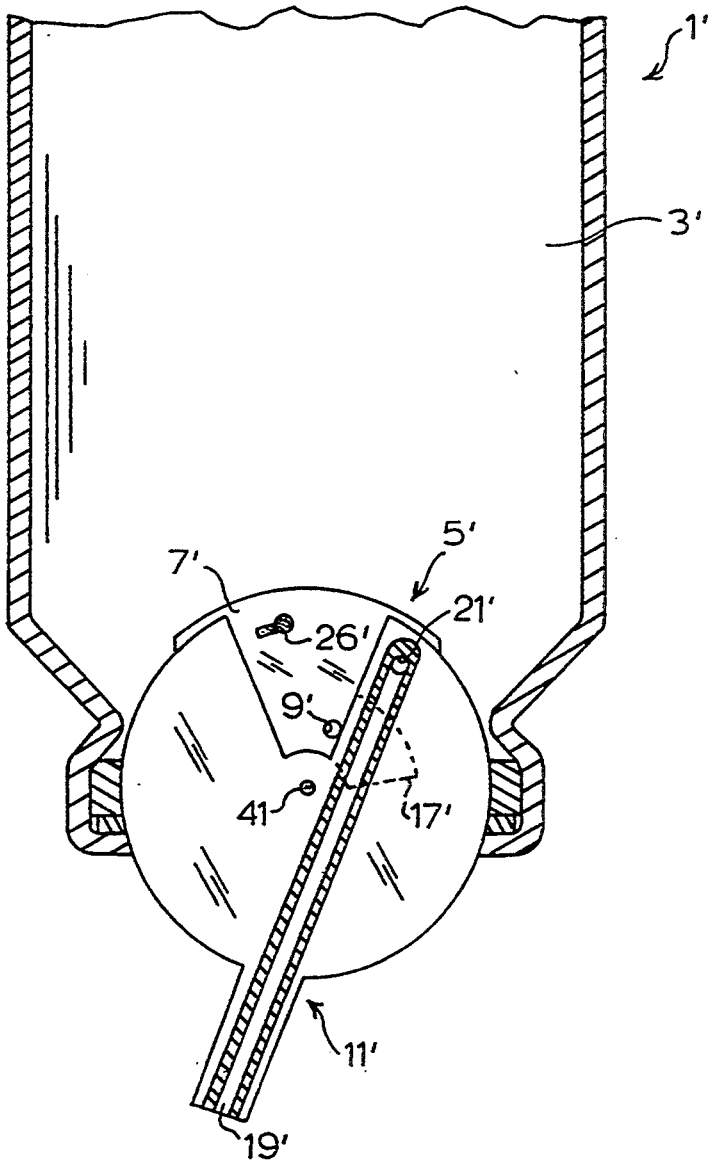
FIGS. 2*a* and 2*b* are side-elevation longitudinal cross-sectional views of another embodiment of the aerosol dispensing apparatus.
Figure 2B:
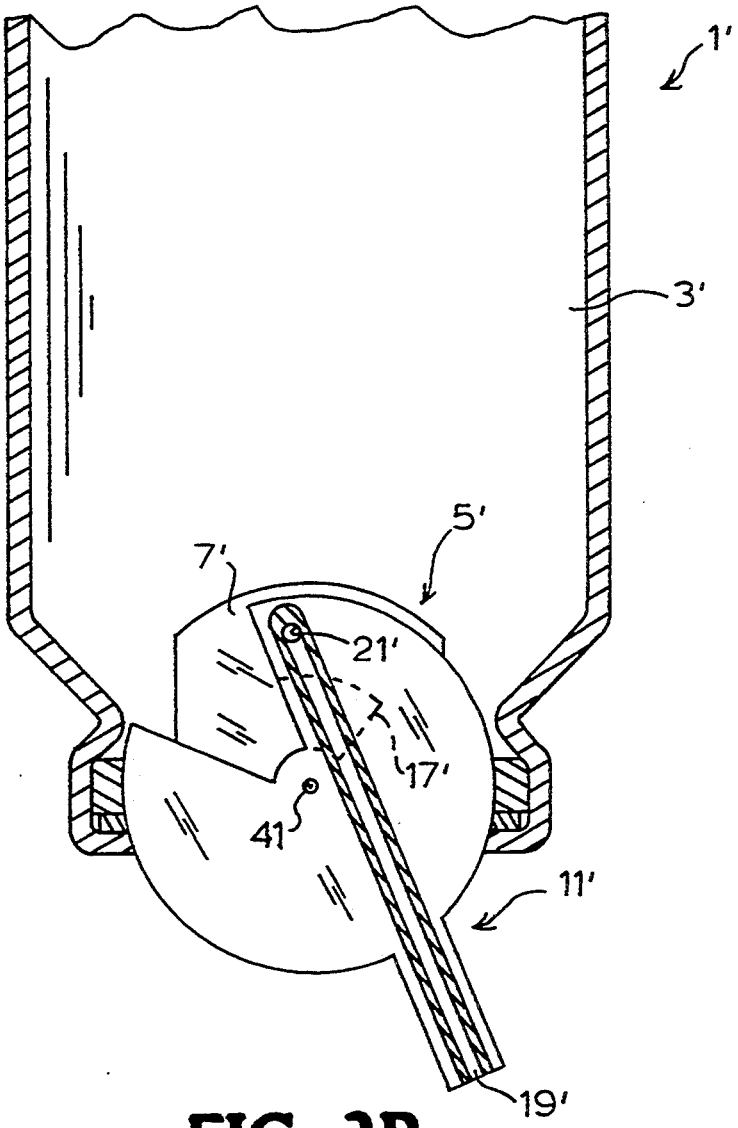

Referring to FIGS. 1 and 2, the metered aerosol dispensing apparatus 1 of the present invention is comprised of: a reservoir 3; a metering chamber 7 having one or more metering chamber ports 9; a stem 11 positioned for slidable movement within the metering chamber 7 containing a dispensing passage 19 and an exhaust port 21; and attached to or integral with the stem 11 is a sealing segment 17 having one or more sealing pads 29 or one or more sealing girdles 29'. Materials suitable for manufacture of the reservoir 3, metering chamber 7 and stem 11 include, but are not limited to: aluminum, steel, copper, brass, nickel, tin and various plastics. A material particularly suited for the manufacture of these components is stainless steel.

Figure 3:
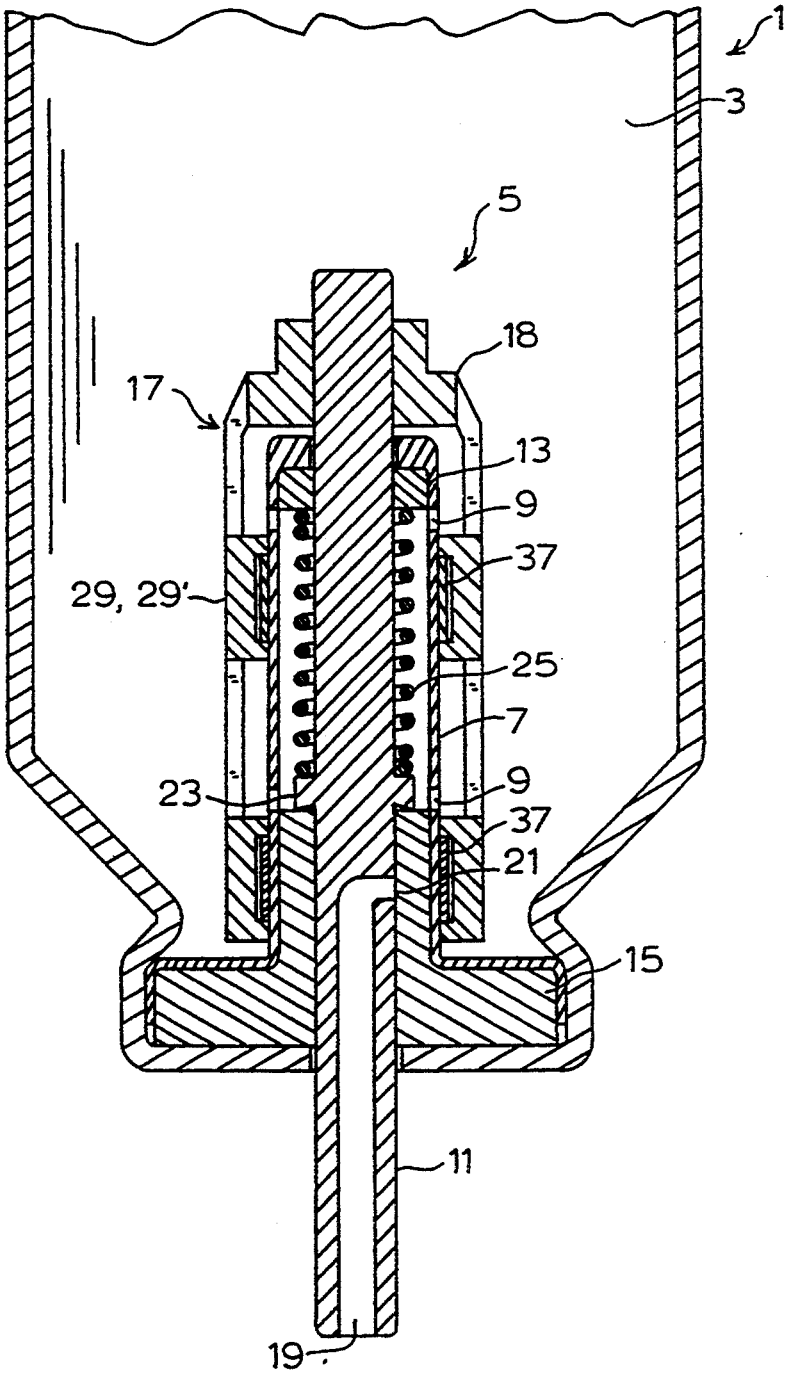
FIG. 3 is a side-elevation longitudinal cross-sectional view of the aerosol dispensing apparatus of FIG. 1 depicting the metering valve in a closed or decompressed position.
Figure 4:
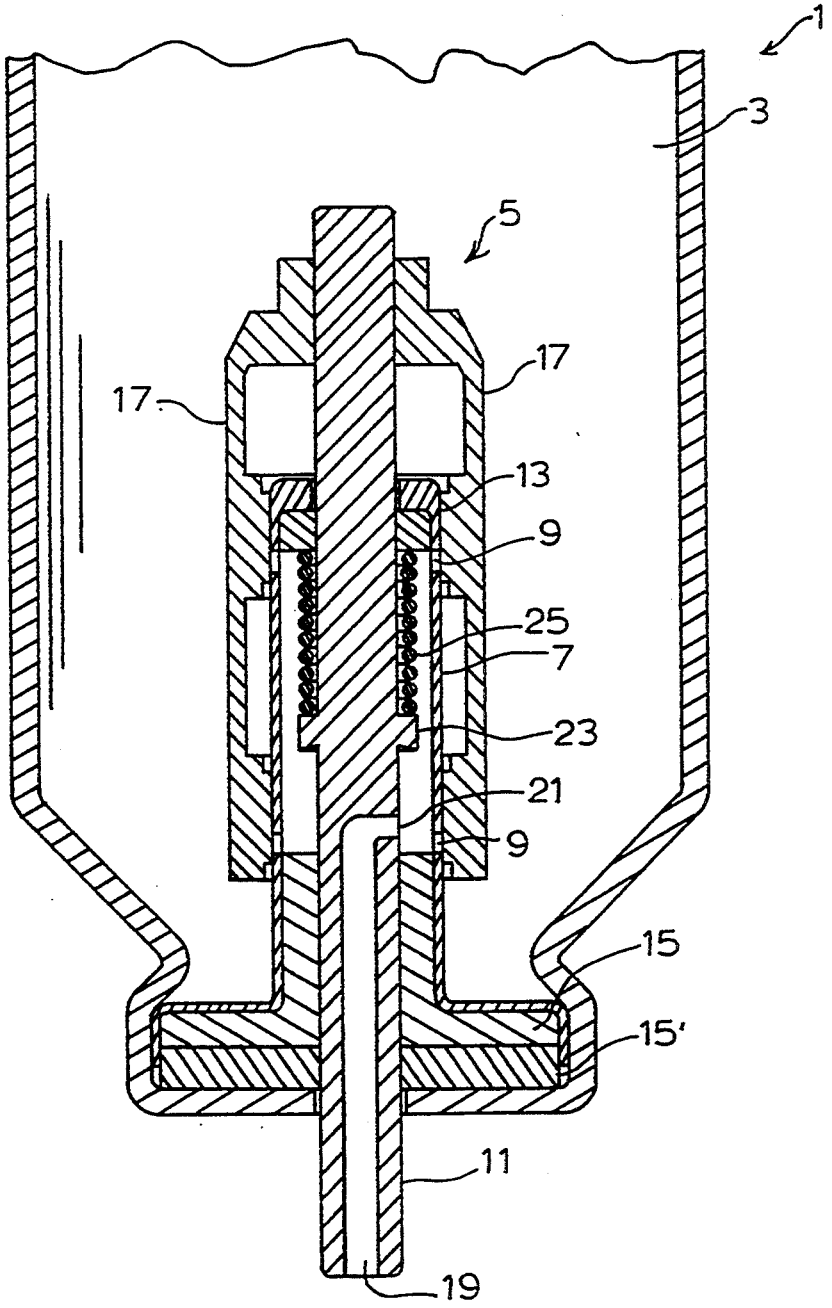
FIG. 4 is a side-elevation longitudinal cross-sectional view of the aerosol apparatus of FIG. 1 depicting the metering valve in an open or compressed position.
Figure 5:
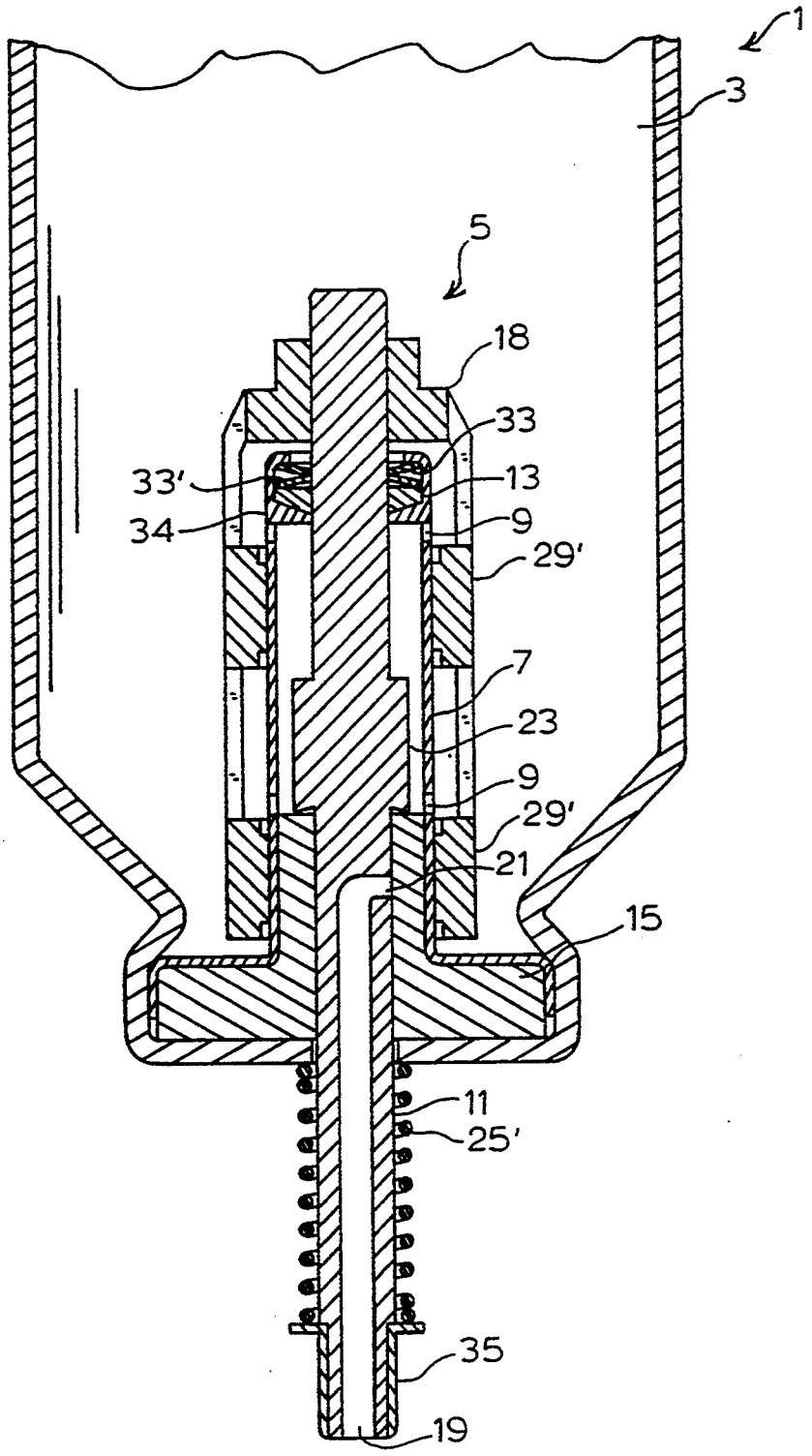
FIG. 5 is a side-elevation longitudinal cross-sectional view of another embodiment of the aerosol dispensing apparatus of FIG. 1 with the metering valve in a closed or decompressed position and wherein the spring is positioned outside of the metering chamber.

Referring to FIGS. 1, 3 and 5 the metered aerosol dispensing apparatus 1 comprises a reservoir 3, which can be of any size or dimensions necessary to hold the material to be aerosolized. Within reservoir 3 resides a metering valve 5. The dimensions or shape of the reservoir 3 is unimportant as long as the reservoir's shape does not interfere with the required physical movements of the metering valve 5. The metering valve 5 comprises a metering chamber 7, which may be of any compatible shape, having one or more metering chamber ports 9, and a stem 11. Located within stem 11 is a dispensing passage 19 comprising a hollow empty channel. The dispensing passage 19 commences with an opening exterior to the dispensing apparatus and terminates in an angular exhaust port 21. Stem 11 is positioned for slidable movement within metering chamber 7 through a lower and upper aperture containing a lower sealing sleeve 15 and an upper sealing sleeve 13. In addition to the upper sealing sleeve 13 and the lower sealing sleeve 15, an additional lower sealing sleeve 15' as depicted in FIGS. 1 and 4, might also be added giving further assurance of sealing. The additional lower sealing sleeve 15' is mounted below the lower sealing sleeve 15. Upper sealing sleeve 13, lower sealing sleeve 15 and additional lower sealing sleeve 15' are manufactured in conjunction with metering chamber 7 and stem 11. Therefore, the exterior shape of the sealing sleeves is determined by the interior shape of the metering chamber 7, and the interior shape of the sealing sleeves is determined by the exterior shape of the stem 11.

Figure 6:
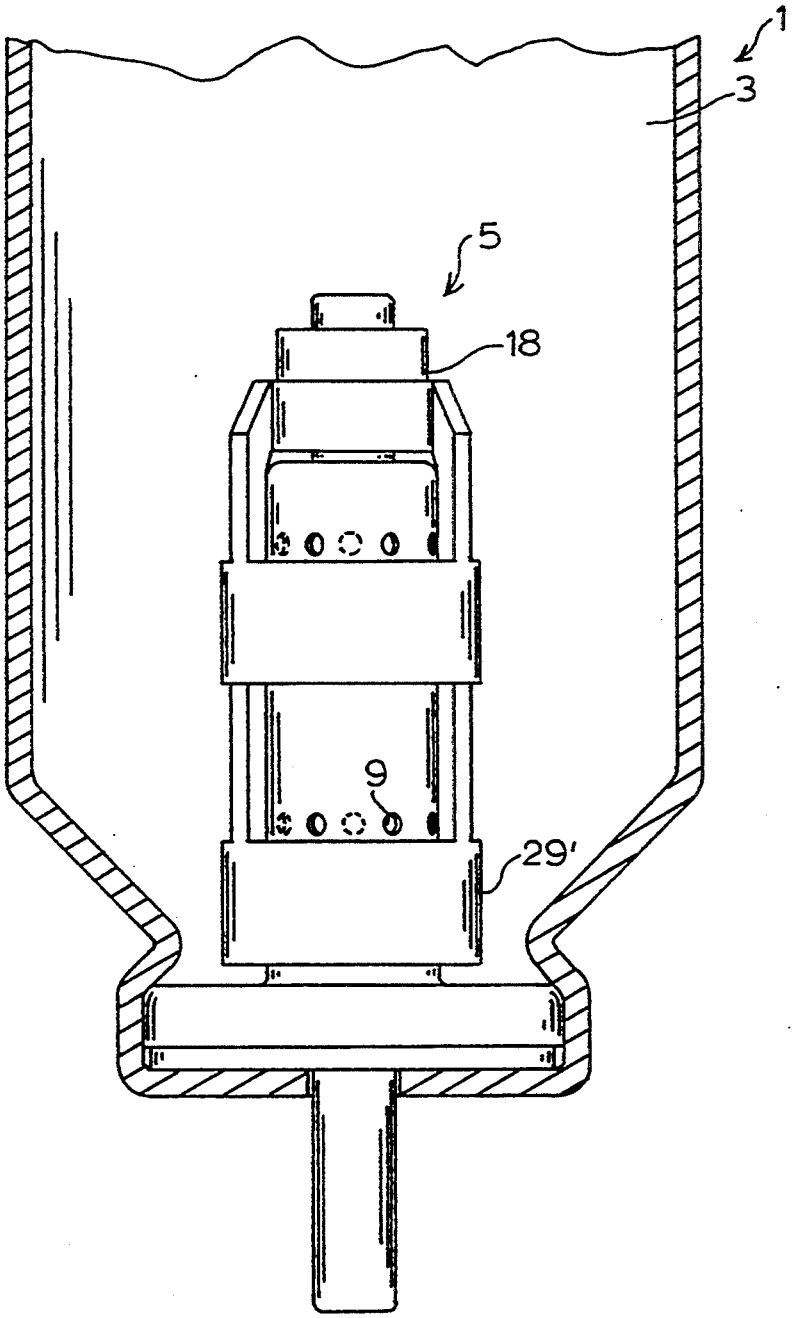
FIG. 6 is a side-elevation longitudinal cross-sectional view of the aerosol apparatus of FIG. 1 with the metering valve in a closed or decompressed position, wherein the sealing segment comprises sealing girdles which surround the perimeter of the metering chamber.
Figure 7:
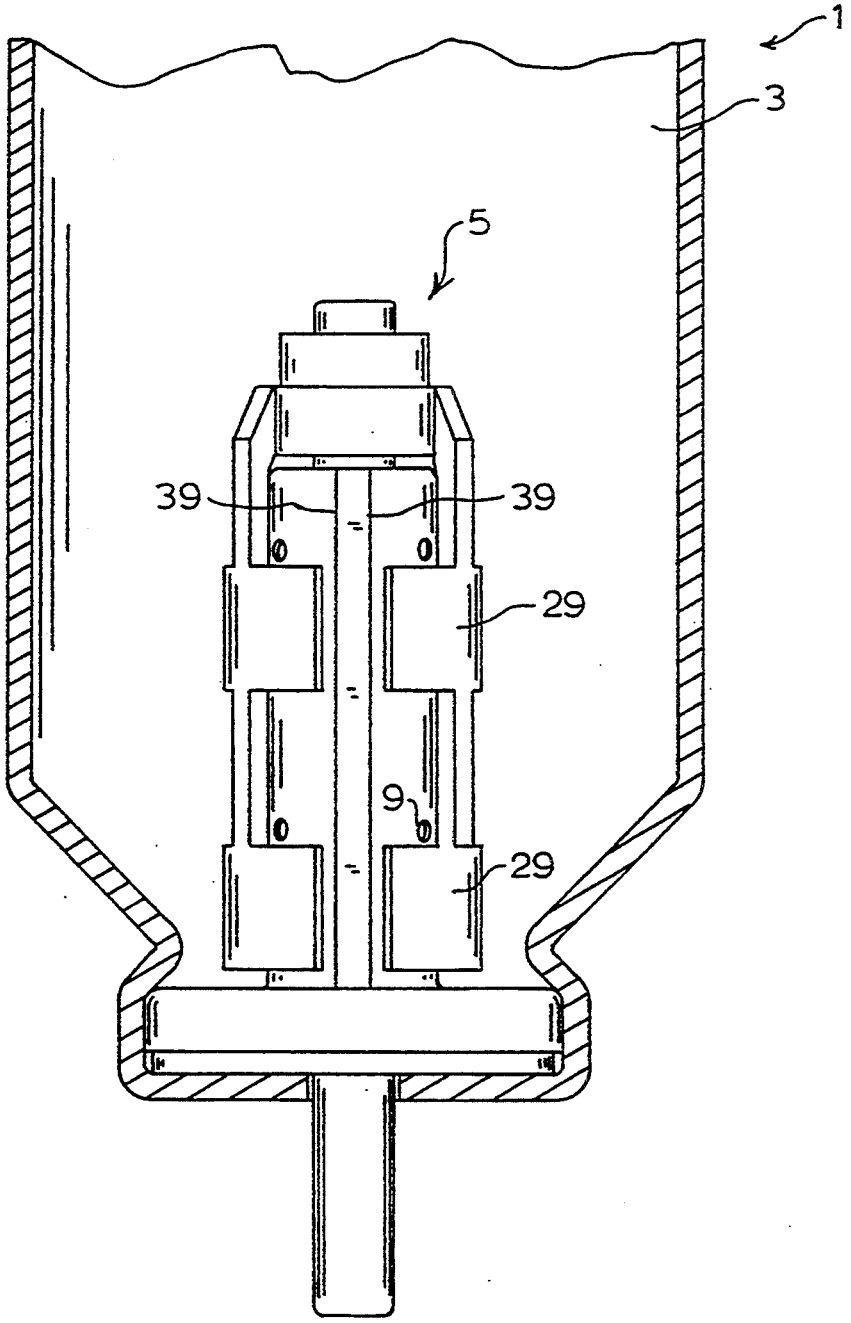
FIG. 7 is a side-elevation longitudinal cross-sectional view of the aerosol apparatus of FIG. 1 with the metering valve in a closed or decompressed position, wherein the sealing segment contains sealing pads.

Attached to stem 11, via collar 18, is sealing segment 17. The sealing segment 17 is further comprised of either portal sealing pads 29, as depicted in FIG. 7 or a portal sealing girdle 29', depicted in FIG. 6, which surrounds the perimeter of the metering chamber 7. The portal sealing pads 29 or portal sealing girdles 29', close the metering ports 9 and seal the metering chamber 7 from the reservoir 3 upon depression of the stem 11. Portal sealing pads 29 differ from sealing girdles 29' in that portal sealing girdles 29' are members that surround the entire perimeter of the metering chamber 7. Whereas portal sealing pads 29 are of a suitable size to cover the metering chamber ports 9 when the stem 11 is depressed, but do not surround the metering chamber 7. The shapes of the portal sealing pads 29 or portal sealing girdles 29' are determined by the exterior shape of metering chamber 7 and the configuration of the metering chamber ports 9. As depicted in FIG. 4, the sealing segment 17, including the portal sealing pads 29 or the portal sealing girdles 29', are comprised of any suitable material which is rigid enough to withstand the pressures of the reservoir 3 and is resilient enough to have suitable sealing properties; preventing fluid from entering the metering chamber 7 when covering the metering chamber ports 9. Suitable materials include: acetyl resin, TEFLON® (tetrafluoroethylene), various metals, polysulfone, and polycarbonate and any other material which exhibits suitable mechanical and chemical properties. Alternatively, as depicted in FIGS. 3 and 5, the portal sealing sleeves 29 or portal sealing girdle 29' could be made of a material divergent from the sealing segment 17. Suitable materials include, but are not limited to: TEFLON® (tetrafluoroethylene), acetyl resin and polyethylene. In particular, TEFLON® (tetrafluoroethylene) is a suitable material.

In another embodiment the portal sealing pads 29 or the portal sealing girdles 29' may contain a portal sealing gasket 37. Referring to FIGS. 1 and 3, the portal sealing pads 29 or the portal sealing girdles 29' contain a portal sealing gasket 37 which is placed between the metering chamber 7 and the portal sealing pads 29 or portal sealing girdles 29'. These portal sealing gaskets, O-rings, or sealing members, supply the sealing function when the portal sealing pads 29 or portal sealing girdles 29' cover the metering chamber ports 9. These portal sealing gaskets 37 maybe made of any material that would adequately seal the metering chamber ports 9 when the metered dose valve 5 is in the open or compressed position. Materials include: acetyl resin, polyethylene, polyurethane, various rubbers, or other elastomeric materials. A particularly useful material is TEFLON® (tetrafluoroethylene).

It will be recognized by persons skilled in the art that the metering chamber ports 9 must be optimized in conjunction with the consistency, viscosity, particle size and any other physical or chemical properties of the material to be aerosolized. Suitable dimensions for the metering chamber ports 9 when aerosolizing fluid materials is from about 0.1 mm to about 2.5 mm in diameter. The appropriate number of metering chamber ports 9 is from 1 to about 10 or more.

Referring to FIGS. 3 and 4 attached to or integral with stem 11 is a flange 23. In a particular embodiment, the lower annular face of flange 23 presents an acute angle to the axis of the stem 11 of from about 45' to about 89'. This angle increases the sealing ability of the flange 23 when pressed against the lower sealing sleeve 15. This increased sealing ability results when the lower sealing sleeve 15 deforms to configure itself to the acute angle of the flange 23.

Placed superior to flange 23 and inferior to upper sealing sleeve 13 around stem 11 is a spring 25. Alternatively, spring 25' could be positioned outside metering chamber 7 and superior to stem cap 35, as depicted in FIG. 5. An example of a prior art reference in which the spring is located in this position is U.S. Pat. No. 4,506,803, issued Mar. 26, 1985 to Franklin et al., and incorporated herein by reference. When the spring 25' is located outside of the metering chamber 7, the metering chamber's volume is free to be fully utilized by the formulation to be aerosolized. Another advantage of locating spring 25' outside of metering chamber 7 is the reduction of fluid accumulation and drug deposition upon to the spring's 25' surface decreasing the chances of metering valve 5 failure. When the spring 25' is located outside of the metering chamber 7 a stem cap 35 with integral flange is fitted over the exterior end of the stem 11 positioning spring 25' between the apparatus' exterior and the stem cap 25 flange.

Suitable materials for the construction of the internal or external spring 25 or 25' include, but are not limited to: steel and various other metals. A material particularly suited for the manufacture of spring 25 or 25' is stainless steel. A spring 25 or 25' of a suitable compression force is required to return the stem 11 and sealing segment 17 after each actuation of the of the metered dose valve 5. Any spring 25 or 25' should also have adequate resiliency allowing the spring to return the stem 11 and sealing segment 17 after each actuation of the metered dose valve 5 until the total number of metered doses contained within the reservoir 3 has been dispensed. A compression force from about 3 to about 12 pounds is suitable. A spring 25 or 25' made of stainless steel having a diameter of about 0.02 cm to about 0.15 cm will have suitable compression force affording sufficient rebound and resilience.

Flange 23 and spring 25 also define the stem's 11 limits of travel. Within these limits of travel the stem 11 occupies an infinite number of positions, however, two positions are of practical importance. In a first position, the decompressed, closed or rest position, as depicted in FIGS. 3 and 5, the stem 11 and sealing segment 17 are biased towards the lower sealing sleeve 15 by a spring 25 or 25' placed around the stem 11. In this rest position the exhaust port 21 is fluidically isolated from the metering chamber 7 and reservoir 3. The sealing segment 17 is positioned such that the metering chamber ports 9 are in fluidic communication with the reservoir 3. While stem 11 is in this position, fluids contained within the metering chamber 7 and reservoir 3 are able to be homogeneously mixed by shaking or other mechanical agitation precluding any amount of fluid from being isolated within metering chamber 7 and therefore preventing the settling of a suspension or the separation of an emulsion which results in uneven dose distribution. This configuration also allows for the elimination of the "bottle emptier" or "dip cup" as illustrated in many prior art references such as U.S. Pat. No. 2,886,217, issued May 12, 1959 to Thiel.

Referring to FIG. 4, stem 11 is in the compressed or open position. Stem 11 is biased toward upper sealing sleeve 13 by physical force exerted by the user. In this position the limiting factor in sliding stem 11 toward upper sealing sleeve 13 is the full compression of spring 25. In the compressed position, sealing segment 17 occludes metering chamber ports 9 preventing the communication of fluids from reservoir 3 into metering chamber 7. Also, with stem 11 in the compressed or open position, exhaust port 21 is in communication with metering chamber 7. This communication allows fluid within the metering chamber 7 to pass into exhaust port 21 and through dispensing passage 19; delivering a predetermined dosage of medicament. The dosage delivered by aerosol dispensing apparatus 1 may be varied by increasing or decreasing the volume of metering chamber 7 or if spring 25 is enclosed within metering chamber 7, by varying the volume spring 25 occupies.

Referring to FIGS. 1, 3, 4 and 5, upper sealing sleeve 13, lower sealing sleeve 15 and, if utilized additional lower sealing sleeve 15' are positioned such that stem 11, with attached or integral sealing segment 17, retains slidable movement within the upper and lower sealing sleeves. In particular, upper sealing sleeve 13 is held in place by two concave bevel springs 33 and 33' and integral metering chamber rib 34 as depicted in FIGS. 1 and 5. This combination of the upper sealing sleeve 13, bevel springs 33, 33' and integral metering chamber rib 34 seals the metering chamber 7 from the reservoir 3 and prevents migration of the upper sealing sleeve 13. Materials suitable for manufacture of bevel springs 33 and 33' include, but are not limited to: aluminum, steel, copper, brass, nickel and tin. A material particularly suited for the manufacture of springs 33 and 33' is stainless steel.

Figure 9:
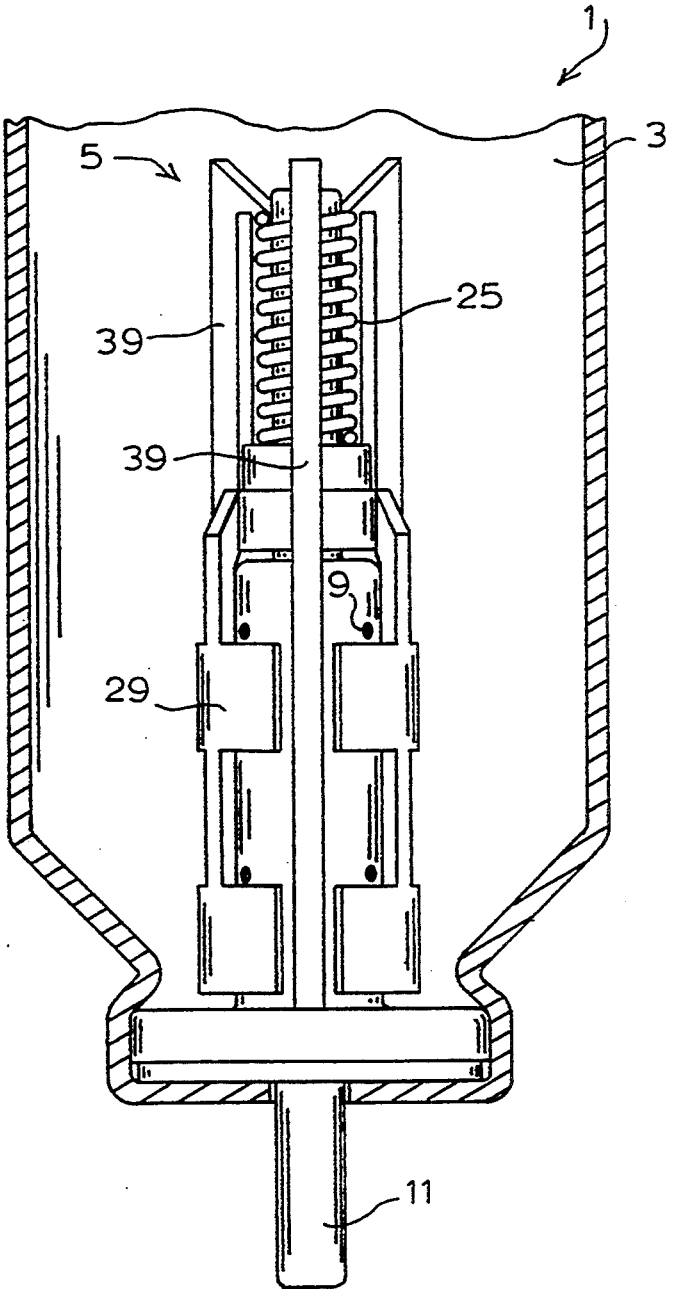
FIG. 9 is a side-elevation longitudinal cross-sectional view of the aerosol apparatus of FIG. 1 with the metering valve in a closed or decompressed position, wherein the metering chamber ridges extended and used to hold the spring.

Upper sealing sleeve 13, lower sealing sleeve 15, and if utilized, additional lower sealing sleeve 15' and bevel springs 33 and 33' are shaped to conform to the interior shape of the metering chamber 7 and the exterior shape of the stem 11. In particular, the shape of the stem 11 and the metering chamber 7 is cylindrical, however, various other stem 11, metering chamber 7, sealing sleeves 13, 15, 15' and bevel springs 33 and 33' shapes might also be utilized to insure alignment between the metering chamber ports 9 and the sealing segment 17. Examples include, but are not limited to, square, rhomboid, triangular, elliptical or rectangular. Another particular technique for insuring alignment between the sealing segment 17, particularly the portal sealing pads 29, and the metering chamber ports 9 is the incorporation of one or more metering chamber ridges 39 as depicted in FIG. 7. A metering chamber ridge 39 would prevent migration of the portal sealing pads 29 ensuring sealing of the metering chamber ports 9 when the stem 11 is in the compressed or open position. Additionally, metering chamber ridges 39 might be extended into reservoir 3 to retain spring 25. Spring 25 would then act against collar 18 to provide the necessary force to return stem 11 and sealing segment 17, as depicted in FIG. 9.

The sealing sleeves 13, 15 and 15' may be composed of any material, which affords effective sealing between stem 11 and metering chamber 7. Suitable materials for the sealing sleeves include: acetyl resin, polyethylene, polyurethane, various rubbers, or other elastomeric materials. In particular, the sealing sleeves 13, 15 and 15', are constructed of TEFLON® (tetrafluoroethylene). TEFLON® (tetrafluoroethylene) provides advantages over previous prior art materials. Softer prior art sealing materials tended to "shear-off" when stem openings moved across their surface during the metered dose valve compression or decompression stroke. These separated pieces of sealing material were then introduced into the aerosol stream contaminating the dispensed dose. Another advantage of employing TEFLON® (tetrafluoroethylene) is the reduced friction coefficient between the stem, the metering chamber and the various sealing surfaces.

Figure 8:
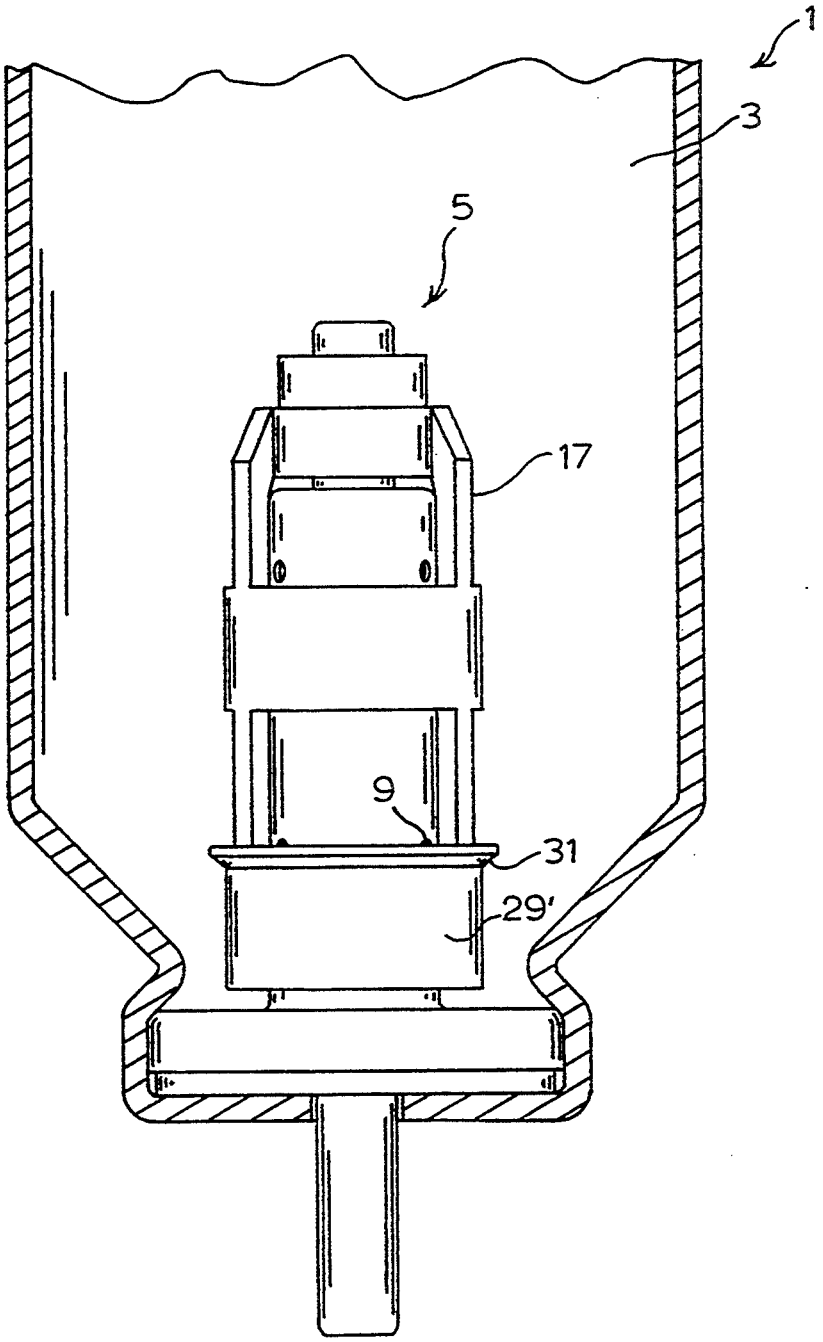
FIG. 8 is a side-elevation longitudinal cross-sectional view of the aerosol apparatus of FIG. 1 with the metering valve in a closed or decompressed position, wherein the sealing segments' lower sealing girdle contains a deflection vane or agitation bar to aid in the movement of the fluid between the reservoir and the metering chamber upon mechanical agitation.

To aid in the mixing of the medicament, propellant and any excipients within the fluid contained in reservoir 3, one or more deflection vanes or agitation bars 31, as depicted in FIG. 8 can be added to the sealing segment 17. Deflection vanes or agitation bars 31 can be used to increase the mixing forces of the fluid contained in the reservoir 3 and also can be used to direct the agitated fluid into the metering chamber 7 from reservoir 3. This additional movement of fluid between the reservoir 3 and the metering chamber 7 improves the likelihood of having a homogenous mixture of fluid in the metering chamber 7 assuring consistent aerosolized doses of medicament.

FIGS. *2a* and *2b* represent another embodiment of the present invention. Referring to FIG. *2a*, the metered aerosol dispensing apparatus 1' comprises a metered dose valve 5' contained within a reservoir 3'. Alternatively, the metered dose valve 5' may be outside of the reservoir 3', with the reservoir connected to the metering chamber port 9' by a hose or other suitable means. The metered dose valve 5' contains a metering chamber 7' having a one or more metering chamber ports 9' and a stem 11', positioned for movement about a pivot 41, within the metering chamber 7'. The stem 11' has a sealing segment 17' and located within the stem 11' is a dispensing passage 19' terminating in an exhaust port 21'. In the closed position as depicted in FIG. *2a*, full communication is allowed between the metering chamber 7' and the reservoir 3' through the metering chamber port 9'.

Referring to FIG. *2b*, in a open position, the stem's 11' sealing segment 17' covers the metering chamber port 9' preventing further communication of fluid between the reservoir 3' and the metering chamber 7'. The stem 11' while in this position also permits the dispensing of the metered amount of material contained in the metering chamber 7'. The dispensing occurs through the exhaust port 21' when the exhaust port 21' and dispensing passage 19' come into communication with metering chamber 7' through a depression 26 contained within the wall of the metering chamber 7'. This depression 26 allows the fluid to be dispensed when the fluid enters the depression and then exits the metered dose valve 5' through exhaust port 21' and dispensing passage 19'. Dispensing through exhaust port 21' and dispensing passage 19' does not occur when the exhaust port 21' is not in communication with the depression 26 as the tolerance between the wall of the metering chamber 7' and face of the stem 11' is such that fluid materials can not pass into the exhaust port 21'. To the face of stem 11' might also be attached a sealing member further facilitating sealing between the metering chamber 7' wall and the stem 11' face. Materials for the sealing member include: acetyl resin, polyethylene, polyurethane, various rubbers, or other elastomeric materials. A particular substance useful for this sealing member is TEFLON® (tetrafluoroethylene). Once the dose contained within the metering chamber 7' is dispensed, through dispensing passage 19' the stem 11' is moved back to the closed position allowing the metering chamber 7' to refill.

THE INVENTION CLAIMED IS:

1. An aerosol dispensing apparatus for dispensing metered amounts of fluid material from a reservoir, the apparatus comprising a body defining the reservoir, and a dispensing valve; the dispensing valve comprising:

a) a metering chamber having two or more metering chamber ports connecting the metering chamber to the reservoir; and b) a stem allowing for slideable movement within the metering chamber, the stem having a dispensing passage; and being connected to a sealing segment allowing for slideable movement over the two or more metering chamber ports, the stem and sealing segment being moveable such that:

i) in a first position the metering chamber is fluidically isolated from the dispensing passage; and the metering chamber is in fluidic communication with the reservoir through the two or .more metering chamber ports; and ii) in a second position the metering chamber is in fluidic communication with the dispensing passage; and the metering chamber is fluidically isolated from the reservoir by the sealing segment occluding the two or more metering chamber ports.

2. The aerosol dispensing apparatus of claim 1 wherein the metering chamber is located within the reservoir.

3. The aerosol dispensing apparatus of claim 2 wherein the sealing segment is external to the metering chamber.

4. The aerosol dispensing apparatus of claim 2 wherein the sealing segment further comprises one or more sealing pads.

5. The aerosol dispensing apparatus of claim 2 wherein the sealing segment further comprises one or more sealing girdles.

6. The aerosol dispensing apparatus of claim 4 wherein the sealing pad further comprises a portal sealing gasket.

7. The aerosol dispensing apparatus of claim 5 wherein the sealing girdle further comprises a portal sealing gasket.

8. The aerosol dispensing apparatus of claim 6 wherein the metering chamber further comprises:

a) a first aperture;

b) a second aperture;

c) an upper sealing sleeve mounted adjacent to the first aperture;

d) a lower sealing sleeve mounted adjacent to the second aperture; and wherein the stem is positioned for slidable movement within the upper and the lower sealing sleeves.

9. The aerosol dispensing apparatus of claim 8 wherein the stem further comprises at least one flange.

10. The aerosol dispensing apparatus of claim 9 further comprising a spring.

11. The aerosol dispensing apparatus of claim 10 wherein a portion of the stem extends exterior of the lower sealing sleeve, and wherein the spring is positioned outside of the metering chamber.

12. The aerosol dispensing apparatus of claim 11 containing 2 to about 10 metering chamber ports.

13. The aerosol dispensing apparatus of claim 12 wherein the metering chamber ports are from about 0.1 mm to about 2.5 mm in diameter.

14. The aerosol dispensing apparatus of claim 13 containing 6 metering chamber ports.

15. The aerosol dispensing apparatus of claim 14 wherein the stem is generally cylindrical and the sealing sleeves comprise substantially annular members.

16. The aerosol dispensing apparatus of claim 15 wherein the metering chamber additionally comprises one or more metering chamber ridges.

17. The aerosol dispensing apparatus of claim 16 additionally comprising an additional lower sealing sleeve.

18. The aerosol dispensing apparatus of claim 17 wherein said fluid material comprises an active agent and a propellant.

19. The aerosol dispensing apparatus of claim 18 wherein the active agent is selected from the group consisting of: salmeterol, fluticasone, albuterol, amiloride, ondansetron, sumatriptan, and remifentanil.

20. An aerosol dispensing apparatus for dispensing metered amounts of fluid material from a reservoir, said apparatus comprising a body defining the reservoir, and a dispensing valve; the dispensing valve comprising:

a) a metering chamber having;

i) an upper aperture connecting the metering chamber to to the exterior of the metering chamber;

ii) a lower aperture connecting the metering chamber to the exterior of the apparatus; and iii) two or more metering chamber ports connecting the metering chamber to said reservoir;

b) an upper sealing sleeve mounted adjacent to said upper aperture;

c) a lower sealing sleeve mounted adjacent to said lower aperture;

d) a stem positioned for slideable movement within said upper and said lower sealing sleeves, said stem having a dispensing passage and being connected to a sealing cage, allowing for slideable movement over the two or more metering chamber ports, the stem and sealing cage being moveable such that;

i) in a first position said dispensing passage is located such that said metering chamber is fluidically isolated from said exterior of said apparatus; and said sealing cage is located such that said metering chamber is in fluidic communication with said reservoir through said two or more metering chamber ports;

ii) in a second position said dispensing passage is located such that said metering chamber is in fluidic communication with said exterior of said apparatus through said dispensing passage; and said sealing cage occludes said two or more metering chamber ports such that said metering chamber is fluidically isolated from said reservoir.

21. A method of using the aerosol dispensing apparatus of claim 1 comprising shaking the apparatus to mix the fluid contained within the reservoir and the metering chamber prior to movement of the stem.

* * * * *